US006021760A

United States Patent [19]

Boecking

[11] Patent Number: 6,021,760

[45] Date of Patent: Feb. 8, 2000

[54] FUEL INJECTION DEVICE FOR INTERNAL COMBUSTION ENGINES

[75] Inventor: Friedrich Boecking, Stuttgart, Germany

[73] Assignee: Robert Bosch GmbH, Stuttgart, Germany

[21] Appl. No.: 09/269,666

[22] PCT Filed: Apr. 3, 1998

[86] PCT No.: PCT/DE98/00944

§ 371 Date: Apr. 30, 1999

§ 102(e) Date: Apr. 30, 1999

[87] PCT Pub. No.: WO99/06690

PCT Pub. Date: Feb. 11, 1999

[30] Foreign Application Priority Data

Jul. 30, 1997 [DE] Germany ..... 197 32 802

[51] Int. Cl.[7] ..... F02M 41/00

[52] U.S. Cl. ..... 123/467; 123/446

[58] Field of Search ..... 123/467, 447, 123/446, 506, 498

[56] References Cited

U.S. PATENT DOCUMENTS

| | | | |
|---|---|---|---|
| 4,603,671 | 8/1986 | Yoshinaga | 123/467 |
| 4,784,101 | 11/1988 | Iwanaga | 123/467 |
| 4,784,102 | 11/1988 | Igashira | 123/498 |
| 4,798,186 | 1/1989 | Ganser | 123/467 |
| 5,186,151 | 2/1993 | Schwerdt | 123/498 |
| 5,819,710 | 10/1998 | Huber | 123/498 |
| 5,875,764 | 2/1999 | Fappel | 123/467 |
| 5,915,361 | 6/1999 | Heinz | 123/467 |

*Primary Examiner*—Carl S. Miller
*Attorney, Agent, or Firm*—Edwin E. Greigg; Ronald E. Greigg

[57] ABSTRACT

A fuel injection device for internal combustion engines in which the motion of a fuel injection valve member is controlled by the pressure in a control chamber. The pressure in the control chamber is controlled by a control valve whose valve member is actuated by way of a hydraulic chamber, with the pressure transmitted from a piezoelectric drive device. The valve member is provided with two sealing surfaces that cooperate with oppositely disposed first and second valve seats wherein when the valve member moves from the first valve seat to the second valve seat, a short-term relief of the control chamber takes place in order to trigger a short pre-injection of fuel. For larger fuel injection quantities, the control valve is brought into an open position between the first and second valve seats or in a closed position.

20 Claims, 3 Drawing Sheets

FUEL INJECTION DEVICE FOR INTERNAL COMBUSTION ENGINES

PRIOR ART

The invention is based on a fuel injection device for internal combustion engines. In a fuel injection device of this type which has been disclosed by DE-C1-195 19 192, the control valve is embodied as a simply functioning flat seat valve which, with its sealing surface, controls the exit of the outflow conduit from the control chamber. The valve member of this control valve is actuated in this connection by means of a piston that has the pressure shoulder. The piston is supported by a compression spring against a second piston, which for its part can be adjusted by the piezoelectric drive device and with its end face disposed next to the pressure shoulder, defines the hydraulic pressure chamber. This known control valve functions so that the valve either opens or closes the outflow conduit. Accordingly, the injection valve member of the fuel injection valve assumes either an open or closed position.

ADVANTAGES OF THE INVENTION

The fuel injection device according to the invention has the advantage over the prior art that two valve seats are provided in the course of the outflow conduit and the closing body is moved with its sealing surfaces from one valve seat to the other upon actuation by the piezoelectric drive device in a single movement sequence, wherein after the outflow conduit is initially closed, it is opened for the meantime by way of the valve chamber and is then closed once more. In the movement sequence of the closing body, this leads to a very short-term relief of the control chamber, which results in an opening of the fuel injection valve member with a likewise very short fuel injection. Very small injection quantities can advantageously be controlled in this manner, which is determined by the movement sequence of the closing body from one valve seat to the other. This movement sequence is essentially dependent on a single excitation of the piezoelectric drive device and can therefore be limited to a very short period of time. The time requirement for this injection can for technical reasons be kept significantly smaller than when, with a fuel injection device of the type as defined herein after, the control valve is opened twice for the same event of the pre-injection, with a first excitation of the piezoelectric drive device and is then closed by a reduction in the excitation. Every time, this switching requires a time-consuming movement reversal of the control valve member and a further time component must be reckoned with, which is required for the respective changing of the excitation state of the piezoelectric drive device. Consequently, the lost time for the control of the injection sequence of the pre-injection and main injection is significantly less in the embodiment according to the invention.

By means of the fuel injection device according to the invention, it is possible here, through appropriate metering of the excitation of the piezoelectric drive device, to keep the closing body in an intermediate position in which, because of the above-mentioned operation, a relief of the control chamber takes place over a prolonged period of time, and through which the desired main injection quantity can then be injected, following the pre-injection quantity, which is introduced in the above-described manner, and after a pause in the injection process. With the fuel injection device according to the invention, an injection can consequently be produced in an extremely precise manner, in which very small pre-injection fuel quantities can be exactly injected, a time period between the pre-injection and the main injection can be exactly maintained, and as a result, the main injection is produced in the customary fashion in a likewise very precisely metered manner.

In an advantageous manner the stroke of the closing body is matched to the adjusting speed by means of the piezoelectric drive device so that the desired pre-injection quantity is produced.

Advantageous improvements of the invention will be explained in more detail in conjunction with the drawings and the subsequent description.

BRIEF DESCRIPTION OF THE DRAWINGS

An exemplary embodiment of the invention is shown in the drawings and will be described in more detail below.

DESCRIPTION OF THE EXEMPLARY EMBODIMENT

Figure 1:
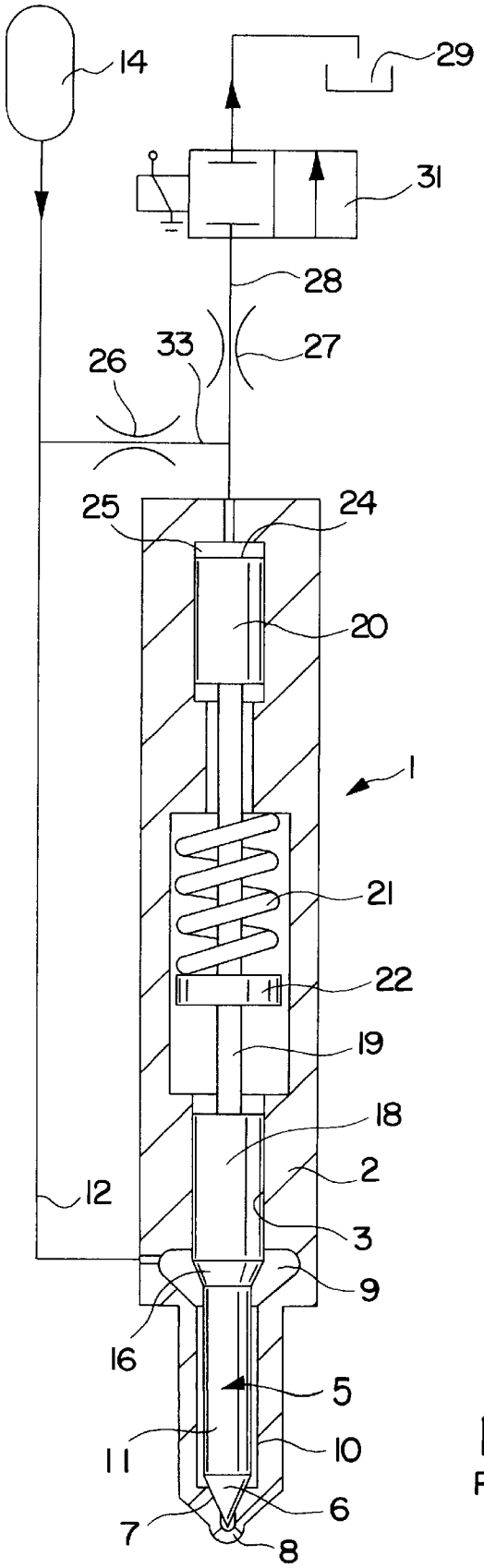
FIG. 1 PRIOR ART
FIG. 1 is a schematic representation of a fuel injection device of a known type.

FIG. 1 shows a fuel injection device of a known type, with a fuel injection valve 1 that has an injection valve housing 2 with a bore 3 in which an injection valve member 5 is guided. On a bore discharge end, this valve member has a conical sealing surface 6, which cooperates with a conical valve seat 7 at the discharge end of the bore. Fuel injection openings 8 are disposed downstream of the valve seat 7, which are separated from a pressure chamber 9 when the sealing surface 6 rests against the valve seat 7. The pressure chamber 9 extends by way of an annular chamber 10 around the part 11 of the injection valve member, which adjoins the sealing surface 6 on the upstream side and has a smaller diameter toward the valve seat 7. The pressure chamber 9 continuously communicates with a high-pressure fuel source 14 by way of a pressure line 12. In the vicinity of the pressure chamber 9, the smaller diameter part 11 of the injection valve member transitions—with a pressure shoulder 16 oriented toward the valve seat 7—into a larger diameter part 18 of the injection valve member. This larger diameter part is guided in a sealed fashion in the bore 3 and on the end remote from the pressure shoulder 16, continues on in a smaller diameter connecting part 19 which connects with a larger diameter piston-shaped end 20 of the injection valve member. The valve member has a spring plate 22 is connected in the region of the connecting part, and a compression spring 21, which acts on the fuel injection valve member in the closing direction, is clamped between this spring plate 22 and the housing 1 of the fuel injection valve.

With an end face 24, whose area is greater than that of the pressure shoulder 16, the piston-like end 20 defines a control chamber 25 in the housing 2 of the fuel injection valve, which chamber continuously communicates with the high-pressure fuel source 14 by way of a first throttle 26 and is connected to a relief chamber 29 by way of a second throttle 27 disposed in an outflow conduit 28. The passage through the outflow conduit 28 is controlled by a control valve 31 with which the outflow conduit is either opened or closed.

Figure 2:
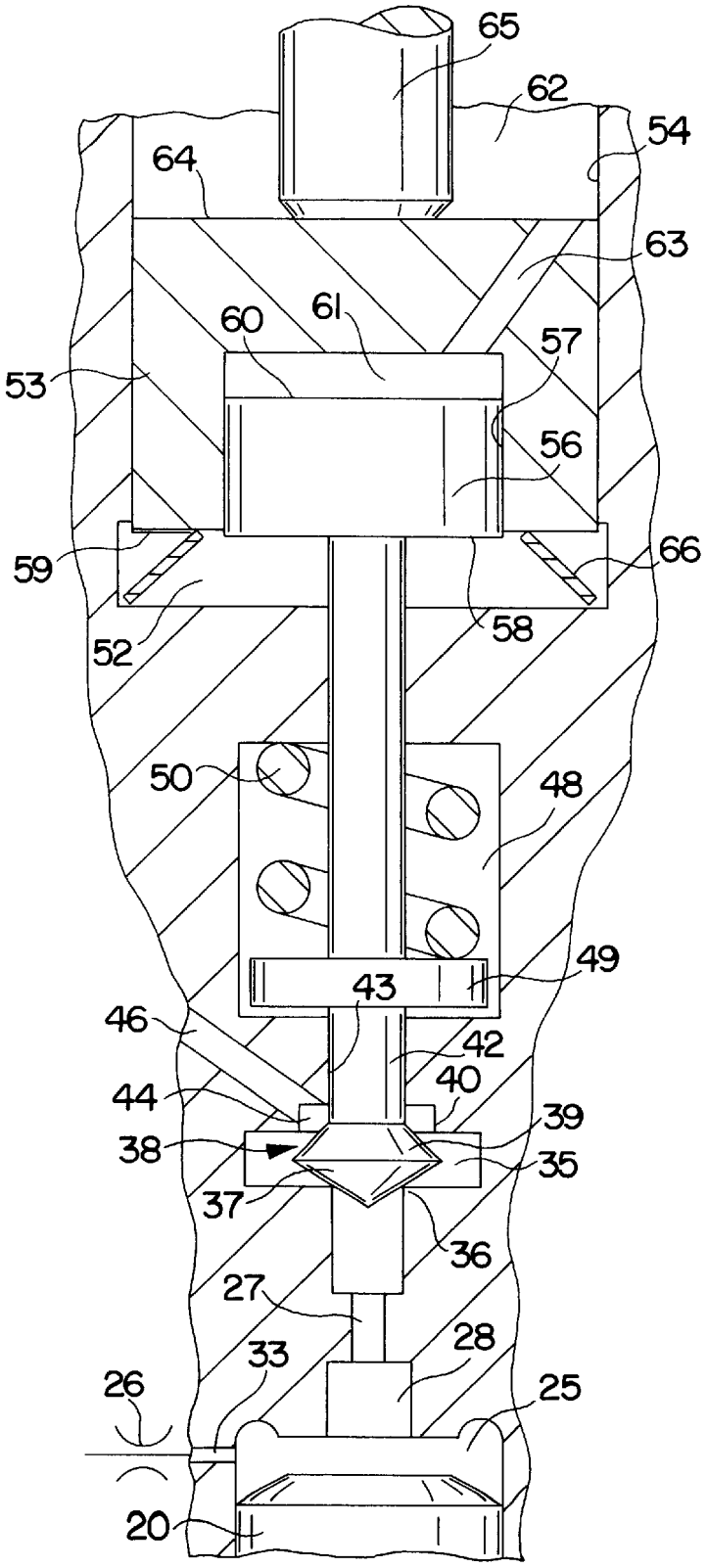
FIG. 2 shows the embodiment of the control valve for the fuel injection device according to FIG. 1, and FIG. 3 plots the movement sequence of the valve member belonging to the control valve over the stroke course of the injection valve member of the fuel injection valve.

The control valve in the version now embodied according to the invention should be inferred from FIG. 2. The piston-like end 20 of the injection valve member is in turn shown there, which defines the control chamber 25 in the full injection valve housing 2. An inflow conduit 33 that contains the first throttle 26 feeds into the control chamber so that the control chamber 25 continuously communicates with the high-pressure fuel source 14. The outflow conduit 28 with the second throttle 27 leads from the control chamber 25 coaxial to the piston-shaped end 20. The outflow conduit feeds into a valve chamber 35 and, at the infeed into this chamber, has a first valve seat 36, which is preferably embodied as a conical valve seat. This cooperates with a likewise conically embodied first sealing surface 37 of a closing body 38, which is movably disposed in the valve chamber 35 and, on its end remote from the first valve surface 37, has a second, likewise conical sealing surface 39, which, with corresponding positioning of the closing body 38, cooperates with a second valve seat 40 that is likewise embodied as conical.

The closing body 38 is disposed at the end of a tappet 42, which is guided in a guide bore 43 in the housing 2 of the fuel injection valve. The guide bore 43 ends in an annular chamber 44 that extends between the guide bore 43 and the second valve seat 40 or the second sealing surface 39, and is defined by the tappet 42 and the wall of the housing 2. The annular chamber 44 continuously communicates with a continuing part 46 of the outflow conduit, which leads to the relief chamber 29. On the other end, the guide bore 43 feeds into a spring chamber 48 inside which the tappet 42 has a spring plate 49 connected thereto, and a compression spring 50, which acts on the tappet, together with its closing body, in the direction of the first valve seat 36, the spring is supported between this spring plate 49 and the housing 2 of the fuel injection valve. From the spring chamber 48, the tappet leads further in a guide bore into a hydraulic pressure chamber 52, which is enclosed by a first piston 53 at the end of a cylinder bore 54 that serves to guide this piston. Coaxial to the first piston 53, a second piston 56 is guided in a blind bore 57 of the first piston and with its first end 58 functioning as a pressure shoulder, together with the end face 59 of the first piston 53 disposed next to it, this second piston 56 defines the pressure chamber 52 as a movable wall. The second end face 60 of the second piston 56 encloses a first relief region 61 in the blind bore 57 and by means of a bore 63 through the bottom of the first piston 53, this first relief region passes over into a second relief region 62.

On the end face 64 which is remote from the end face 59 of the first piston 53 and defines the relief region 62 in the cylinder bore, a piezoelectric drive device 65 functions as a drive device and in a known manner, this piezoelectric drive device 65 can be composed of a number of elements and can be excited or de-excited by means of a control device not shown here in detail, and upon excitation, undergoes a length extension with a high application of force, which is transmitted to the first piston 53.

The first piston 53 is kept in constant contact piezoelectric drive device 65 without excitation by the piezoelectric drive device 65 by means of a spring plate 66 that is disposed in the hydraulic pressure chamber 52. In the position shown in FIG. 2, the piezoelectric drive device 65 is not excited and the tappet 42 is acted on by the compression spring 50 so that the first sealing surface 37 rests in a sealed fashion against a first valve seat 36 and consequently, the control chamber 25 is closed. Therefore, the pressure sets in there that also prevails in the high-pressure fuel source 14 because of the constant communication between this source and the control chamber 25 by way of the inflow conduit 33. This high pressure loads the injection valve member so that it is kept in the closed position supported by the compression spring 21, in opposition to the pressure forces acting on the pressure shoulder 16.

If the piezoelectric drive device is now excited, then the first piston 53 is moved, which increases the pressure in the hydraulic pressure chamber 52 so that afterwards, due to the pressure acting on the end face 58 of the second piston 56 that is connected to the tappet 42, this second piston moves out of the way and plunges further into the blind bore 57, wherein it displaces fuel from the first relief region 61 into the second relief region 62. This second region has grown in volume and thereby supports the plunging motion of the second piston into the blind bore 57. The event in turn results in the fact that the tappet 42 moves counter to the force of the compression spring 50 and thereby lifts the closing body 38 up from the first valve seat 36. At this moment, a relief of the control chamber 25 takes place since the outflow conduit 28 is connected to the continuing outflow conduit part 46 by means of the now open valve seats 36 and 40. If the excitation of the piezoelectric drive device 65 is so great that the tappet 42 brings the closing body 38 with its second sealing surface 39 against the second valve seat 40, then a re-closing of the outflow conduit occurs, which results in the fact that after an intermediary relief, the full pressure of the high-pressure fuel source is built up again in the control chamber 25. If the above-described process is carried out in this manner, then the control chamber 25 is relieved for a short time between the opening of the outflow conduit at the first valve seat 36 and its re-closing at the second valve seat 40. This results in the fact that the injection valve member 5 is also relieved and is moved for a short time into an at least partially open position. In this manner, on the basis of the short relief time period, a very small fuel injection quantity can be injected. Having reached the second valve seat 40, the closing body thus keeps the outflow conduit 28, 46 closed, and by means of the pressure increase in the control chamber 25, the injection valve member 5 is brought lastingly back into the closed position. After this very small fuel injection, which can preferably be a pre-injection, after an injection pause, the is control chamber 25 can as a result be relieved again in order to actuate the injection valve member for a main injection by virtue of the fact that the piezoelectric drive device is triggered so that the closing body 38 remains in an intermediary position between the first valve seat 36 and the second valve seat 40. This is the particular advantage of a piezoelectric drive device, that it can also assume intermediary positions in accordance with an excitation. This intermediary position is only maintained now until the required main injection quantity has been injected and then the excitation of the piezoelectric drive device is, for example, entirely canceled so that the tappet, together with the closing body 38, returns to the closed position against the first valve seat 36 through the action of the compression spring 50.

Figure 3:
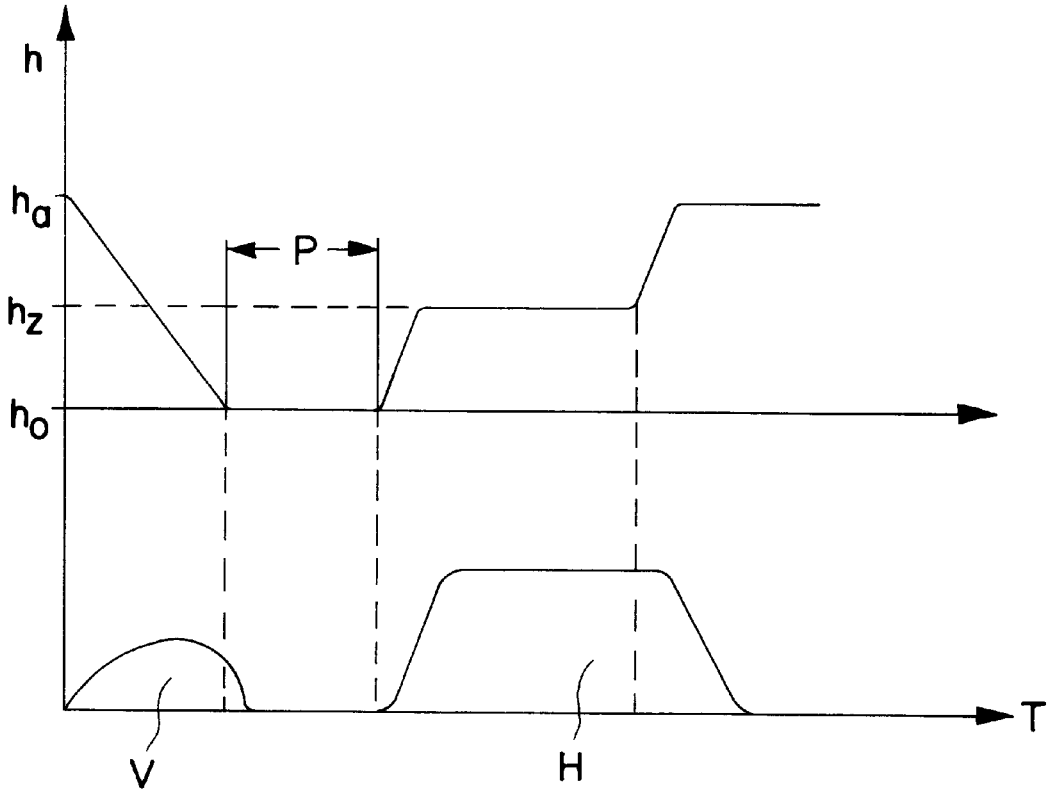

In FIG. 3, the movement sequence of the control valve is depicted in the upper curve and the movement sequence of the fuel injection valve member 5 is reproduced in the lower curve. In the upper curve, it is clear that upon an excitation of the piezoelectric drive device at point 0 of the abscissa, the tappet 42 travels a negative stroke over time starting from $h_a$ until, at the level $h_o$, the closing body 38 has reached the second valve seat 40. In the graph below this, an injection valve member movement V is produced over this stroke, which corresponds to a pre-injection. After a time pause P, over which the fuel injection valve member 5, with a certain lag behavior, has traveled back into the closed position, for example a partial excitation of the piezoelectric drive device occurs, which moves the tappet 42 to an intermediary level $h_z$ so that both of the valve seats 36 and 40 are open. The resulting relief of the control chamber 25 produces the needle stroke H of the injection valve member 5 for the main injection. With another de-excitation of the piezoelectric drive device, the tappet 42 travels back into the initial position in accordance with the stroke $h_a$ through the action of the compression spring. The injection valve member closes with lag behavior which is also based on the dynamic relief of the control chamber 25 and the design of the throttles 26 and 27.

With this embodiment according to the invention, extremely small injection quantities can be produced for the operation of an internal combustion engine with a pre-injection and a main injection. This device has the particular advantage that an excitation of the piezoelectric drive device only takes place when an injection is supposed to occur. The piezoelectric drive device is consequently without current over the large part of the operation of the internal combustion engine and electrical energy only has to be produced for the injection events.

The foregoing relates to a preferred exempalary embodiment of the invention, it being undrestood that other variants and embodiment thereof are possible within the spirit and scope of the invention, the latter being defined by the appended claims.

I claim:

1. A fuel injection device for internal combustion engines, comprising a high-pressure fuel source from which a fuel injection valve (1) is supplied with fuel, said valve has an injection valve member (5) for controlling injection openings (8) and a control chamber (25) that is defined by a movable wall (24), which is at least indirectly connected to the injection valve member (5), an inflow conduit (33) which is dimensioned by means of a throttle (26) and is connected with a high-pressure fuel source, an outflow conduit (28, 46) with a definite maximal outflow cross section (27) to a relief chamber (29), at which outflow conduit a first valve seat (36) of a control valve (31) is embodied, said control valve has a valve member (42, 38) that is acted on in a direction of the first valve seat (36) by a spring (50) and is provided with a first sealing surface (37), which cooperates with the first valve seat (36), and on an end remote from the first sealing surface (37), said valve member (42, 38) has a pressure shoulder (58) oriented toward the valve seat (36), said pressure shoulder defines a hydraulic pressure chamber (52) that is closed on another end by means of a movable wall (59) which is actuated by a piezoelectric drive device (65), an area of the movable wall (59) is greater than an area of the pressure shoulder, the control valve member (42, 38) has a tappet (42) that is guided in a guide bore (43) and the pressure shoulder (58) is disposed on a first end of this tappet that protrudes from the guide bore (43), and said valve body (38) is disposed on a second end of this tappet that protrudes from the guide bore, said closing body is moved by the tappet (42) back and forth in a valve chamber (35) and on an end oriented toward the control chamber (25), the closing body includes said first sealing surface (37), which cooperates with the first valve seat (36), and has a second sealing surface (39), which is disposed on a second end of said closing body remote from the first sealing surface (37) and cooperates with a second valve seat (40) that is disposed on the outflow conduit (28, 43) and is situated on the opposite end from the first valve seat (36), wherein the distance between the first valve seat (36) and the second valve seat (40) is so great that in an intermediary position, the closing body (38) is not in contact with either of the valve seats and by way of the valve chamber (35), a communication is produced between the outflow conduit parts (28, 43) that adjoin the valve seats.

2. The fuel injection device according to claim 1, in which a stroke of the closing body (38) from a contact against the first valve seat to a contact with the second valve seat is so great that by taking into account the actuation speed of the closing body, a relief of the control (25) chamber, which relief produces a pre-injection, is executed during a connection of the outflow conduit parts with one another, which exists during this movement from said first valve seat until this connection is interrupted when the closing body contacts the second valve seat.

3. The fuel injection device according to 1, in which the first valve seat (36) is embodied as a conical valve seat.

4. The fuel injection device according to 2, in which the first valve seat (36) is embodied as a conical valve seat.

5. The fuel injection device according to claim 3, in which the second valve seat (40) is embodied as a conical seat.

6. The fuel injection device according to claim 4, in which the second valve seat (40) is embodied as a conical seat.

7. The fuel injection device according to claim 3, in which the second valve seat is embodied as a ball seat.

8. The fuel injection device according to claim 4, in which the second valve seat is embodied as a ball seat.

9. The fuel injection device according to claim 3, in which the second valve seat is embodied as a flat seat.

10. The fuel injection device according to claim 4, in which the second valve seat is embodied as a flat seat.

11. The fuel injection device according to claim 3, in which the closing body is embodied as a ball.

12. The fuel injection device according to claim 4, in which the closing body is embodied as a ball.

13. The fuel injection device according to claim 5, in which the closing body is embodied as a ball.

14. The fuel injection device according to claim 9, in which the closing body is embodied as a ball.

15. The fuel injection device according to claim 1, in which the guide bore (43) feeds into an annular chamber (44) which is formed between the tappet (42) emerging from the guide bore, the second valve seat (40), and the wall of the housing (1) of the injection valve, and the outflow conduit (43) leads from this annular chamber to a relief chamber (29).

16. The fuel injection device according to claim 2, in which the guide bore (43) feeds into an annular chamber (44) which is formed between the tappet (42) emerging from the guide bore, the second valve seat (40), and the wall of the housing (1) of the injection valve, and the outflow conduit (43) leads from this annular chamber to a relief chamber (29).

17. The fuel injection device according to claim 3, in which the guide bore (43) feeds into an annular chamber (44) which is formed between the tappet (42) emerging from the guide bore, the second valve seat (40), and the wall of the housing (1) of the injection valve, and the outflow conduit (43) leads from this annular chamber to a relief chamber (29).

18. The fuel injection device according to claim 5, in which the guide bore (43) feeds into an annular chamber (44) which is formed between the tappet (42) emerging from the guide bore, the second valve seat (40), and the wall of the housing (1) of the injection valve, and the outflow conduit (43) leads from this annular chamber to a relief chamber (29).

19. The fuel injection device according to claim 1, in which the pressure shoulder (58) is disposed on a first piston (56) that is connected to the tappet (42) and is moved in a bore (57) of a second piston (53), which is guided in a cylinder bore (54), and with an end face (59) disposed next to the pressure shoulder (58), this second piston encloses the hydraulic chamber (52) and is held in contact with the piezoelectric drive device (65) disposed on the opposite end by means of a spring (66).

20. The fuel injection device according to claim 2, in which the pressure shoulder (58) is disposed on a first piston (56) that is connected to the tappet (42) and is moved in a bore (57) of a second piston (53), which is guided in a cylinder bore (54), and with an end face (59) disposed next to the pressure shoulder (58), this second piston encloses the hydraulic chamber (52) and is held in contact with the piezoelectric drive device (65) disposed on the opposite end by means of a spring (66).

* * * * *